United States Patent [19]

Wright, deceased et al.

[11] 4,160,886

[45] Jul. 10, 1979

[54] KEYBOARDS AND METHODS OF MAKING KEYBOARDS

[75] Inventors: Duane H. Wright, deceased, late of Coeur d'Alene, Id., by Greta B. Wright, personal representative; Stephen F. Meyer, Hayden Lake, Id.

[73] Assignee: Clare-Pendar Co., Post Falls, Id.

[21] Appl. No.: 817,550

[22] Filed: Jul. 21, 1977

[51] Int. Cl.[2] ..... H01H 13/70

[52] U.S. Cl. ..... 200/5 A; 200/308; 200/329; 235/145 R

[58] Field of Search ..... 200/5 R, 5 A, 86 R, 200/159 B, DIG. 1, 339, 340, 329, 308; 84/433; 235/145 R; 197/98; 400/479, 485, 490, 491; 364/706, 708, 709

[56] References Cited

U.S. PATENT DOCUMENTS

| | | | |
|---|---|---|---|
| 4,029,916 | 6/1977 | Chu | 200/159 B X |
| 4,029,916 | 6/1977 | Chu | 200/5 A |
| 4,039,068 | 8/1977 | Giorza et al. | 235/145 R X |
| 4,092,527 | 5/1978 | Luecke | 364/709 |

*Primary Examiner*—James R. Scott

*Attorney, Agent, or Firm*—Mason, Kolehmainen, Rathburn & Wyss

[57] ABSTRACT

A data entry keyboard includes a key array overlying a switching assembly so that a switch is operated when a corresponding key is depressed. The key array is made by forming a transparent plastic sheet into a blank having a number of upwardly extending key projections and having a downwardly extending switch actuating projection adjacent each key projection. Indicia are applied to the underside of the sheet so the indicia are both visible and protected from wear. A back coat overlies the indicia on the underside of the sheet. The blank is cut to remove material surrounding each key and to define an integral hinge permitting deflection of each key and its associated switch actuating projection. The key array is assembled with the switching assembly, and a mask overlies the key array and permits access to individual keys.

9 Claims, 9 Drawing Figures

KEYBOARDS AND METHODS OF MAKING KEYBOARDS

BACKGROUND OF THE INVENTION

The present invention relates to keyboards, and more particularly to improvements in data entry keyboards and in methods of manufacturing keyboards.

A data entry keyboard includes a number of normally manually operated pushbuttons, commonly called keys, associated with a number of switches so that depression of a key results in operation of a corresponding switch. Such keyboards find many uses including, for example, electronic calculators, programming devices for appliances and industrial controllers and the like, security systems, communications equipment and others.

Typical keyboards of the type known in the past include a switching array comprised of a number of switches. An array of pushbutton keys overlies the switches so that depression of a selected key results in operation of a corresponding switch. Most commonly, each key is discrete from the key array and is formed as a separate part, as by an injection molding process or the like. Consequently, the key array includes structure for retaining and for mounting each key for movement relative to its associated switch.

Use of separate, discrete keys and the associated retaining and mounting structure results in a complex and expensive assembly. Difficulties may be encountered not only in properly positioning the keys during manufacture but also in preventing jamming of keys during use of the keyboard. Moreover, due to the expense of molding or otherwise fabricating a number of discrete parts for a given keyboard assembly, known production methods are not well adapted to frequent modifications such as are associated with the manufacture of small batches or short runs of a given keyboard design.

Among the important objects of the present invention are to provide improvements in keyboards and in keyboard manufacturing methods thereby to overcome the above and other disadvantages of known keyboards and methods. Another important object is to provide an extremely simple and economically manufactured key array and to provide a method for manufacturing such a key array. Yet a further object is to provide a keyboard manufacturing method suited to frequent modifications in keyboard structures and designs. Another object is to provide a keyboard and a key array utilizing a minimum number of parts and avoiding difficulties with key positioning, jamming of keys and the like.

In brief, in accordance with the above and other objects of the present invention, there is provided a keyboard including a switching assembly having a number of switches and a key array overlying the switching assembly. The key array includes a sheet of plastic having upwardly extending projections defining individual keys. Apertures in the sheet of plastic partially surround each key freeing the corresponding key for movement and defining an integral hinge connected between the key and the adjacent portion of the plastic sheet. Each key is provided with a switch actuating structure so that depression of the key results in operation of a corresponding switch.

In accordance with an important feature of the present invention, there is provided a method for manufacturing a keyboard key array. A sheet of plastic is formed into a blank having a plurality of key projections extending upwardly from the top surface of the sheet. The formed sheet, or blank, is then cut to define integral hinges interconnecting the sheet with eacy key projection and to free each key projection for movement relative to the sheet upon flexing of the integral hinges.

BRIEF DESCRIPTION OF THE DRAWINGS

The present invention together with the above and other objects and advantages may be best understood from consideration of the embodiment of the invention illustrated in the accompanying drawings, wherein.

DESCRIPTION OF THE PREFERRED EMBODIMENTS

Figure 2:
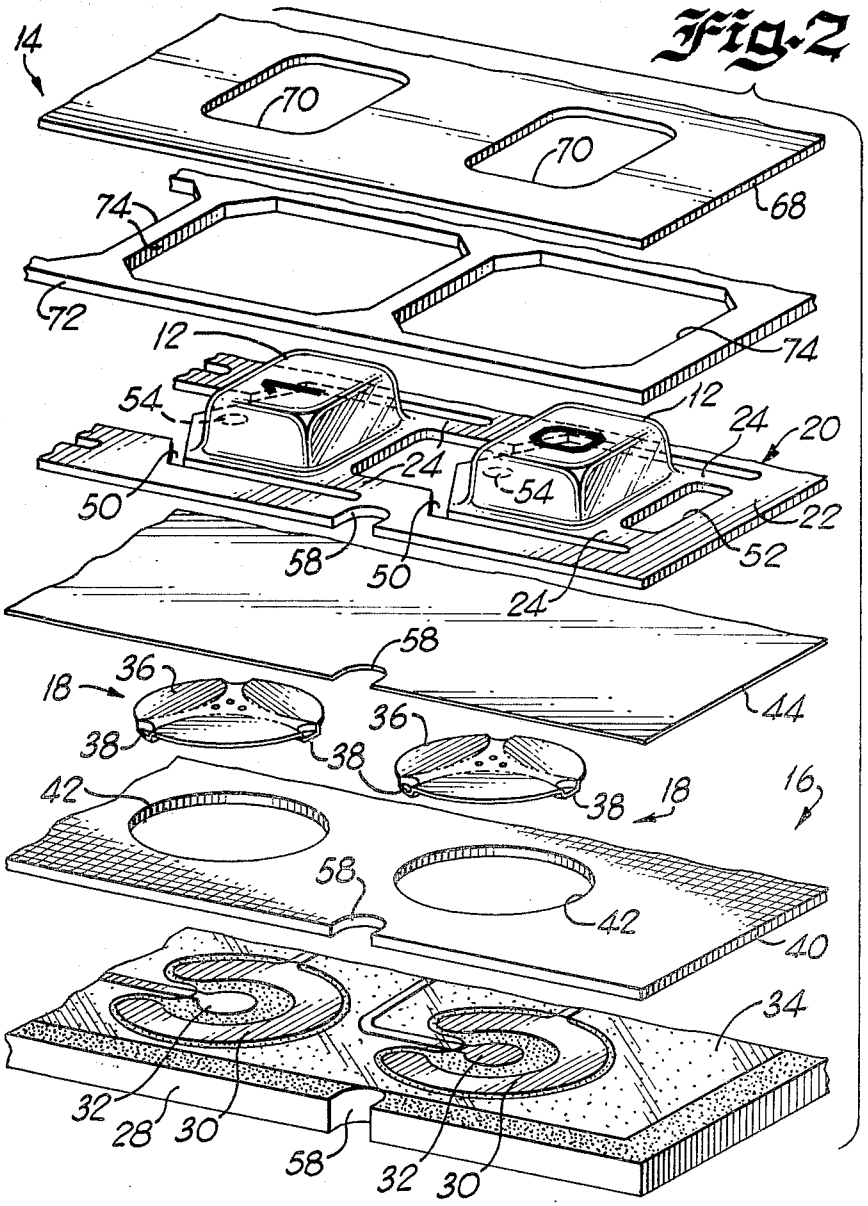
FIG. 2 is a fragmentary, exploded perspective view, on an enlarged scale, illustrating components of the keyboard of FIG. 1.

Having reference now to the accompanying drawings, and initially to FIGS. 1–6, there is illustrated a keyboard designated as a whole by the reference numeral 10 embodying and manufactured in accordance with the principles of the present invention. In general, the keyboard 10 includes a number of individual pushbuttons or keys 12 associated with a key assembly designated in its entirety by the reference numeral 14. The key assembly 14 overlies a switching assembly designated as a whole by the reference numeral 16 and including a number of individual switches each generally designated by the reference numeral 18 and each corresponding with one of the keys 12. Any of the keys 12 may be depressed, normally manually, and in response the corresponding switch 18 is operated.

In accordance with an important feature of the present invention, all of the keys 12 are associated with and are integral with a one-piece key array generally designated as 20. In addition to the keys 12, the key array 20 includes a flat, planar base portion 22 to which each key 12 is integrally connected by hinges 24 to the end that each key is independently movable. Since the key array 20 comprises a single, integral part, difficulties encountered heretofore in positioning, mounting, forming, and assembly of separate keys are avoided in a simple and novel fashion.

Figure 1:
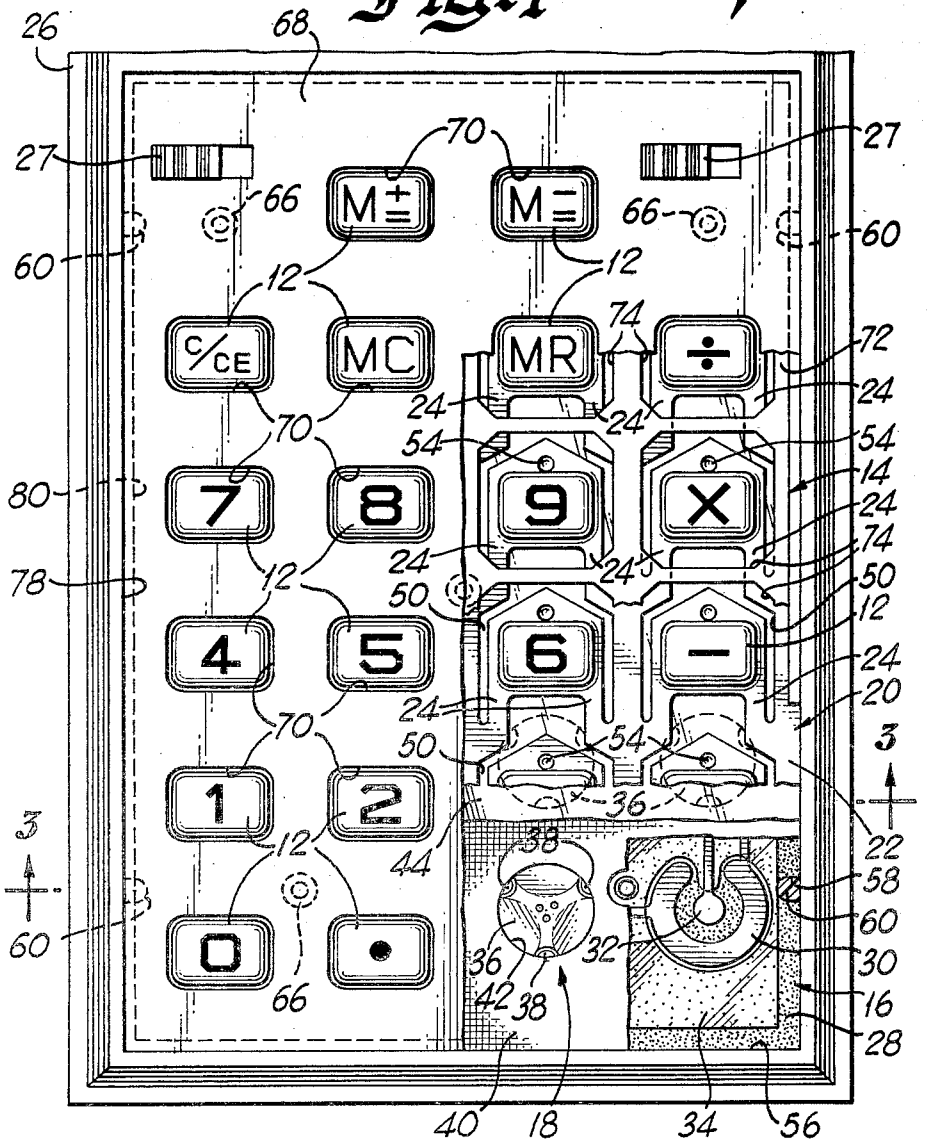
FIG. 1 is a top elevational view, with portions broken away, of a data entry keyboard constructed in accordance with the present invention.
Figures 3, 4, 5, 6:
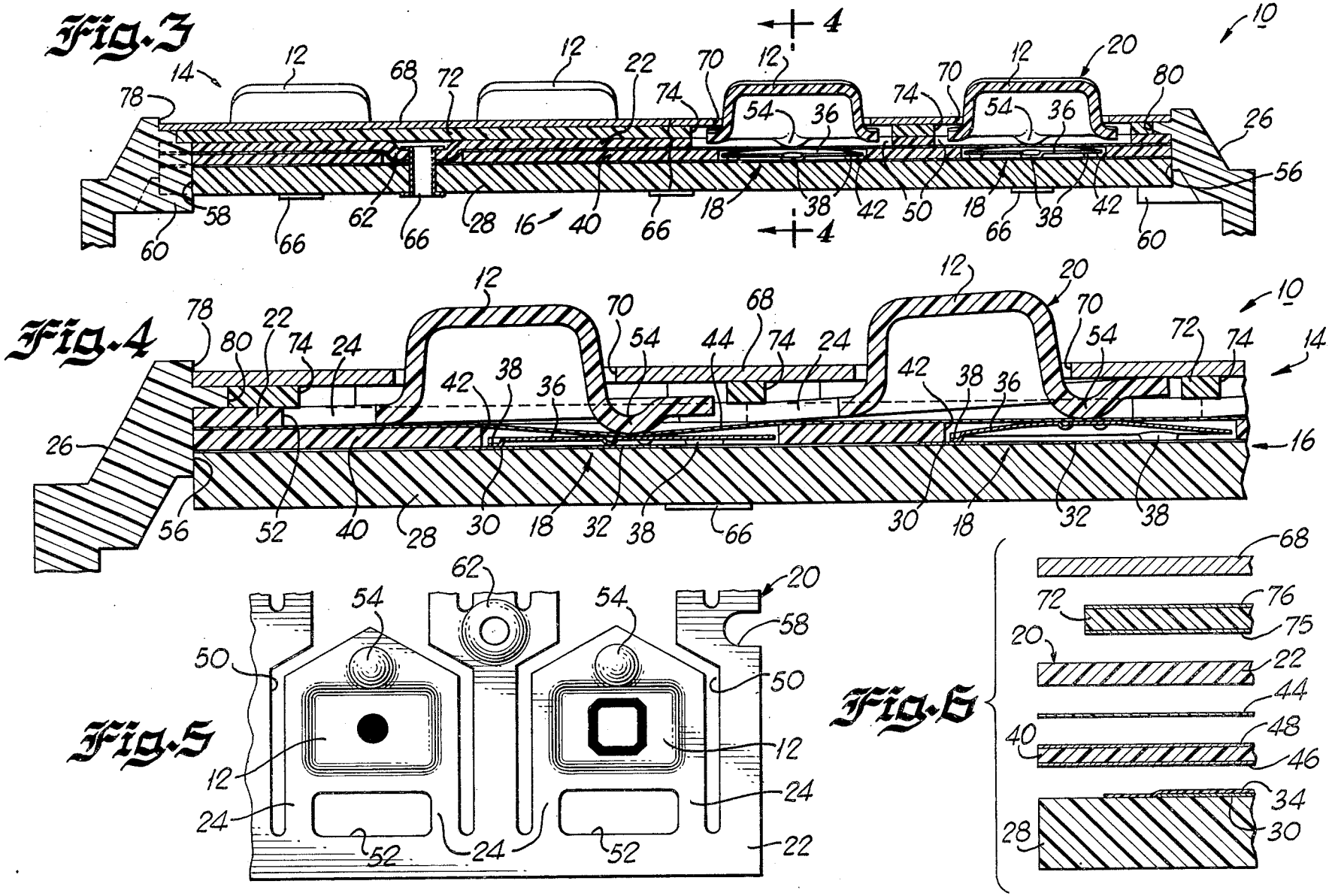
FIG. 3 is a sectional view on an enlarged scale of the keyboard of FIG. 1 taken along the line 3—3 of FIG. 1.
FIG. 4 is a sectional view on an enlarged scale taken along the line 4—4 of FIG. 3 and illustrating one key in the operated condition.
FIG. 5 is a fragmentary bottom elevational view of a portion of the key array of the keyboard of FIG. 1.
FIG. 6 is a fragmentary, sectional, exploded view of components of the keyboard of FIG. 1.

Proceeding now to a more detailed description of the keyboard 10, in the illustrated arrangement, the keyboard 10 is associated with a hand held electronic calculator including a housing 26, portions of which appear in FIGS. 1, 3 and 4. The keyboard 10 may include slide switches 27 of any known construction if desired. The logic circuitry, the digital display and other portions of the calculator unnecessary to an understanding of the present invention are omitted from the drawings. It should be understood that the principles of the present invention may be applied to keyboards of many types in addition to calculator keyboards.

The key array and key assembly of the present invention may be utilized to operate switches and switching assemblies of many types. In the illustrated arrangement, the switching assembly 16 comprises a printed circuit board 28 provided with a conductor array including, for each switch 18, a conductive pad portion 30 and a fixed switch contact portion 32. Suitable conductors extend from the portions 30 and contacts 32 for interconnection with the circuitry to be controlled by operation of the switches 18. A barrier layer 34 of insulating material such as a plastic film or a deposited plastic coating overlies the surface of the board 28 with the exception of the pad portions 30 and contacts 32 in order to prevent inadvertent short circuiting or the like.

Each switch 18 includes a generally concavo-convex domed contact member 36 for providing a tactile spring action and for selectively completing an electrical circuit between the corresponding pad portion 30 and fixed contact 32. Each disc 36 includes peripheral foot portions 38 resting against the corresponding pad portion 30. When the center of a disc 36 is depressed by depression of one of the keys 12, the disc moves with a "snap" or "cricket" action and its center portion engages the fixed contact 32. The discs 36 are maintained in position relative to the PC board 28 by means of a spacer 40 formed of insulating material and having openings 42 formed therein for receiving the individual discs 36.

In order to maintain the switches 18 free from dust, moisture and other contaminants, a seal 44 in the form of an impervious thin plastic sheet overlies the spacer 40 and discs 36. The board 28, the spacer 40 and the seal 44 may be attached together in any suitable manner. For example, in FIG. 6 the spacer 40 is illustrated as provided with layers or coatings 46 and 48 of a contact adhesive.

An extremely simple and reliable arrangement results from the fact that the key array 20 comprises an integral arrangement of the keys 12 and the base portion 22. The array 20 is formed from a thin sheet of stiff but somewhat flexible thermoplastic material. Each key 12 comprises a generally rectangular or box-shaped projection extending upwardly from the base portion 22. Other key shapes, configurations, and designs could be adopted, depending upon design objectives, space requirements and the like. The keys 12 are provided in an array corresponding to that of the switches 18 so that each key 12 is associated with one of the switches 18.

Figure 9:
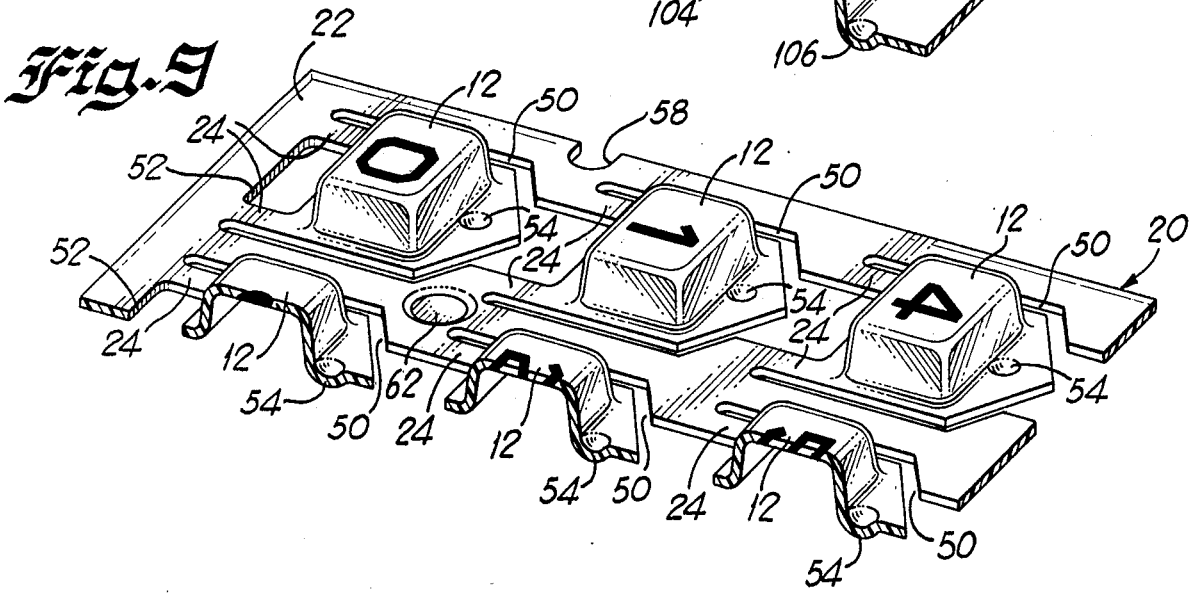
FIG. 9 is a view similar to FIG. 7 illustrating the completed key array.

In order to free each key 12 for independent movement relative to the base portion 22, each key 12 is partially surrounded by a generally U-shaped opening or aperture 50 formed in the base portion 22. Each key 12, however, remains joined to the base portion 22 by means of a pair of hinges 24 in most cases separated by a portion of an adjacent opening 50. A slot or aperture 52 extends between the hinges 24 of the end keys 12 (FIGS. 5, 6 and 9). If desired, the slot 52 could be omitted and the opening 50 modified so that a single hinge 24 could be associated with each key 12.

Due to the integral hinge connection of each key 12 to the base portion 22, each key may be independently depressed. A switch operating projection 54 extends downwardly adjacent each key 12. Preferably, and as illustrated, the projection 54 is disposed on the opposite side of the key 12 from the hinges 24 so that maximum lever arm length is achieved and minimum key movement is required for switch operation. Upon assembly, each projection 54 overlies the center of the corresponding disc 36 so that depression of the key results in movement of the disc from the unoperated position illustrated at the right-hand side of FIG. 4 to the operated position illustrated at the left-hand side of FIG. 4. When a key 12 is released after being depressed, the disc 36 and the key 12 return to their initial, unoperated position due to resiliency of the disc 36 and/or due to the resiliency of the integral hinges 24.

The key array 20 may be mounted in assembly with the switching assembly 16 in any desirable manner. In the illustrated arrangement, the calculator housing 26 includes a mounting recess 56 sized to receive the switching assembly 16 and the key array 20. The key array as well as the switching assembly 16 includes a number of peripheral notches 58 adapted to receive projections 60 in the housing 26. The key array 20 also includes spacer or foot portions 62 adapted to be received in apertures 64 (FIG. 3) in the spacer 40. The key array 20 is mechanically fastened to the circuit board 28 by means of rivets 66, although it should be understood that adhesive or other types of mechanical fastenings could be used.

Overlying the key array 20 of the keyboard 10 is a masking panel 68 including a number of apertures 70 through which the keys 12 extend upwardly. The masking panel 68 covers the hinges 24, apertures 50 and 52, switch operating projections 60 and other details of the key array 20 and switching assembly 16. The visible surface of the masking panel 68 may be provided with any of a number of decorative surface treatments. A spacing and stiffening element 72 is interposed between the key array 20 and the masking panel 68, and is provided with apertures 74 permitting free movement of the keys 12. As can be seen in FIG. 6, the element 72 is provided with layers 75 and 76 of contact adhesive for attaching the element 72 and the panel 68 to the key array. The housing 26 includes recesses 78 and 80 sized respectively to receive and position the panel 68 and the element 72.

In many instances, it is desirable for the keys 12 to be provided with indicia of various types. The key array 20 is formed of a transparent plastic material, and as a result the indicia may be applied to the bottom surface or underside of the keys 12. Consequently, the indicia are protected from wear. The indicia may be underlayed with a backing coat of any desired color, and contrasting colors may be used if desired for designating different groups of functions or the like. In addition, in accordance with known practice, the backing coat may be translucent and indicator lights such as LED's or the like (not shown) may be provided beneath the individual keys 12.

Figure 7:
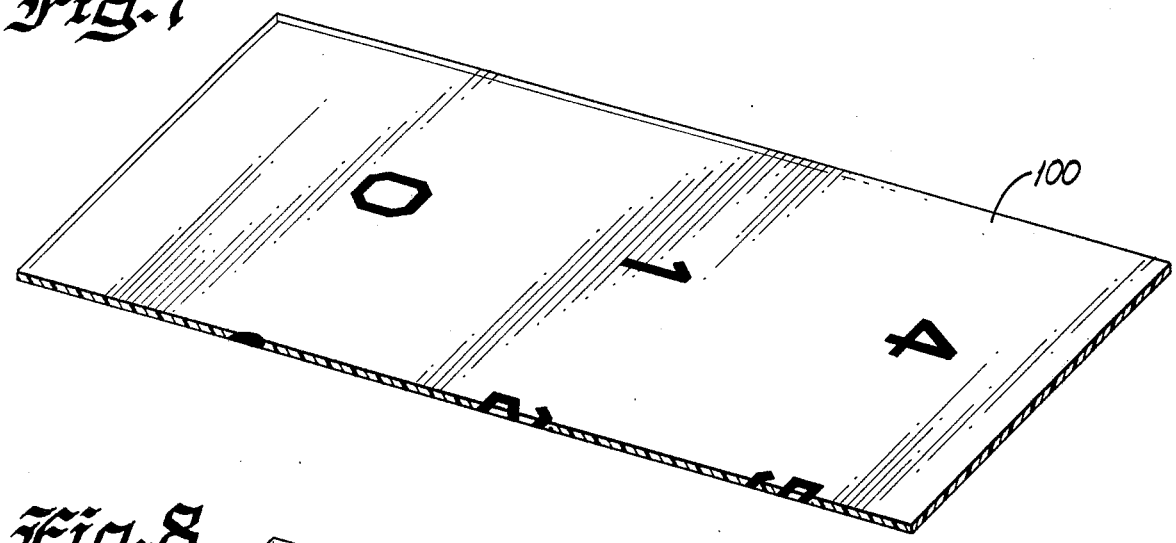
FIG. 7 is a fragmentary perspective view illustrating a sheet of plastic to be made into a key array in accordance with the method of the present invention.
Figure 8:
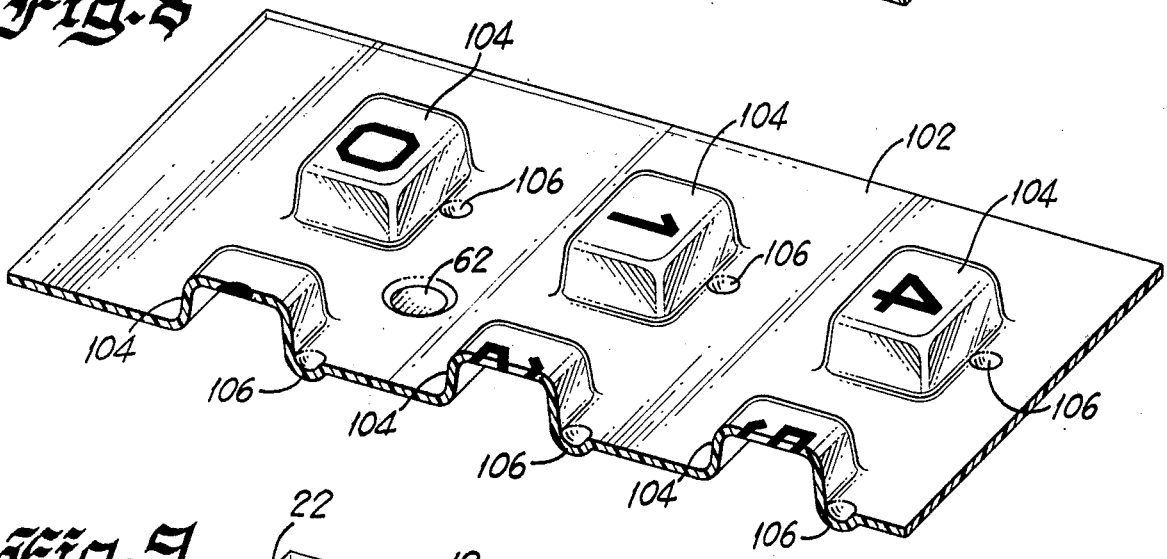
FIG. 8 is a view similar to FIG. 7 illustrating a blank formed during the method.

Having reference now to FIGS. 7–9, an important feature of the present invention resides in improvements in methods for making a key array such as the key array 20. Important advantages of the method of the present invention are extreme simplicity and low cost, and the capability of easily manufacturing different configurations, types, colors and designs of key arrays at small expense so that short runs or small batches are practical.

More specifically, in accordance with the invention, the key array 20 is fabricated from a sheet 100 of thin, thermoplastic sheet material of uniform thickness. As illustrated in FIG. 8, the sheet 100 is formed into a blank 102. This forming operation can be carried out in an extremely economical manner by any well known vacuum forming or sheet forming operation. For example, any of the sheet forming operations described at pages 406 and 407 of the *McGraw-Hill Encyclopedia of Science and Technology,* McGraw-Hill Book Company, Inc., 1960, Vol. 10, may be utilized. Such forming techniques normally involve conforming the thermoplastic sheet 100 while in a pliant state to a mold through the application of a pressure differential. The desired pliant state is typically achieved by heating the sheet 100.

The formed blank 102 includes a number of upwardly extending projections 104 having the shape and configuration of the keys 12 to be formed in the key array 20. A downwardly extending protuberance 106 adjacent each projection 104 has the configuration of the switch operating projection 60 associated with each key 12 of the key array 20. In addition, if desired, the spacers or foot portions 62 may be formed in the blank 102.

The blank 102 is then subjected to a cutting or stamping operation in order to form the completed array 20 as illustrated in FIG. 9. In this cutting or stamping operation, the apertures or slots 50 and 52 are formed adjacent each projection 104 thereby to form the individual keys 12 and to form the integral hinges 24 extending between the keys 12 and the base portion 22 of the key array 20.

Indicia may be applied to each key 12 at any desired point during the operation. In the illustrated arrangement, the indicia are applied to the underside of the thermoplastic sheet material 100 prior to the forming and cutting operations. This approach has the advantage that the indicia may be applied by any desired printing or silk screening or similar operation to the flat sheet so that difficulties encountered with a contoured sheet are avoided. One or more backing coats having desired characteristics such as color, opacity and the like may be applied beneath the indicia at any point during or following the fabricating process.

Because the mold used in a sheet forming or vacuum forming operation is relatively inexpensive, large tooling costs are not incurred with any given keyboard design. As a result, design modifications involving different configurations and arrays of keys ae readily achieved. The economy of the process is further enhanced by the small initial cost of the thermoplastic sheet material and by the fact that the indicia and backing coats or the like can be applied easily.

While the invention has been described with reference to the illustrated embodiment, it should be understood that details of this embodiment are not intended to limit the scope of the invention as defined in the following claims.

What is claimed and desired to be secured by Letters Patent of the United States is:

1. A keyboard assembly comprising:

support means;

a switching assembly mounted on said support means and including a plurality of pressure actuated switch means;

and a key array overlying said switching assembly for selective actuation of said switching means;

said key array including a sheet of plastic of uniform thickness having been formed while in a pliant state into a generally flat base portion and a plurality of projecting keys each corresponding with one switching means;

apertures in said plastic sheet partially surrounding each of said keys and freeing said keys for movement relative to said base portion;

integral hinge portions of said plastic sheet interconnecting said base portion with said keys; and a switch actuating means on each key and aligned with one of said switch means.

2. The assembly of claim 1, said plastic sheet being transparent, and indicia applied to the underside of said keys.

3. The assembly of claim 1, said apertures including a generally U-shaped opening partially surrounding each key.

4. The assembly of claim 3, said apertures further including a slot defining two said integral hinge portions connecting each key with said base portion.

5. The assembly of claim 1, said switch actuating means comprising a projection extending downwardly adjacent each key.

6. The assembly of claim 5, each switch operating projection being located on the opposite side of the corresponding key from the corresponding integral hinge portion.

7. The assembly of claim 1 further comprising a masking panel overlying said key array and including openings through which said keys project.

8. A key array for operating a switching assembly in a data entry keyboard, said key array comprising:

a one-piece, integral body formed from thermoplastic sheet material of uniform thickness by sequential sheet forming and cutting operations;

said body including a generally planar base portion;

a plurality of keys extending upwardly from said base portion;

apertures in said body partially separating said keys from said base portion; and integral hinges connecting said keys to said base portion.

9. The key array of claim 8, said thermoplastic material being non-opaque, and indicia applied to the under surface of said keys.

* * * * *